United States Patent [19]

Lyman, Jr.

[11] Patent Number: 4,565,036

[45] Date of Patent: Jan. 21, 1986

[54] FRONT-SUPPORTED TELESCOPING SEATING STRUCTURE

[76] Inventor: Hugh M. Lyman, Jr., P.O. Box 38, Enumclaw, Wash. 98022

[21] Appl. No.: 577,060

[22] Filed: Feb. 6, 1984

[51] Int. Cl.[4] ..... F04H 3/12

[52] U.S. Cl. ..... 52/9; 52/183; 297/DIG. 2

[58] Field of Search ..... 52/9, 183; 108/93, 901; 182/106; 256/59; 297/236, 423, 424, DIG. 2

[56] References Cited

U.S. PATENT DOCUMENTS

| | | | |
|---|---|---|---|
| Re. 29,635 | 5/1978 | McClelland et al. | 52/9 |
| 3,222,827 | 12/1965 | Smith | 52/9 |
| 3,389,511 | 6/1968 | Drehobl | 52/9 |
| 3,608,251 | 9/1971 | Scaggs | 52/9 |
| 4,467,569 | 8/1984 | Blanchard et al. | 52/9 |

FOREIGN PATENT DOCUMENTS

| | | | |
|---|---|---|---|
| 1213591 | 3/1966 | Fed. Rep. of Germany | 52/9 |

*Primary Examiner*—Alfred C. Perham
*Attorney, Agent, or Firm*—Seed and Berry

[57] ABSTRACT

A telescoping seating structure having a plurality of rows, each row having two or more row assemblies, a seating assembly, and a front support. Each row assembly having a carriage assembly, a vertical post attached to the carriage assembly and extending upwards, and a cantilevered arm attached to the vertical post and extending forwardly. Each seating assembly having a vertical front riser at the forward free end of the cantilevered arm, a seat rigidly attached to the front riser, a tread panel positioned upon the cantilevered arm, and a vertical rear riser extending upwardly from the tread panel. A front support wheel attached to the lower surface of the tread panel or cantilevered arm engages the upper surface of the adjacent seat below when the structure is in the retracted position. The entire seating assembly is formed as an integral unit of molded fiberglass, and the upper surface of the seat is contoured.

20 Claims, 3 Drawing Figures

FIG. 1
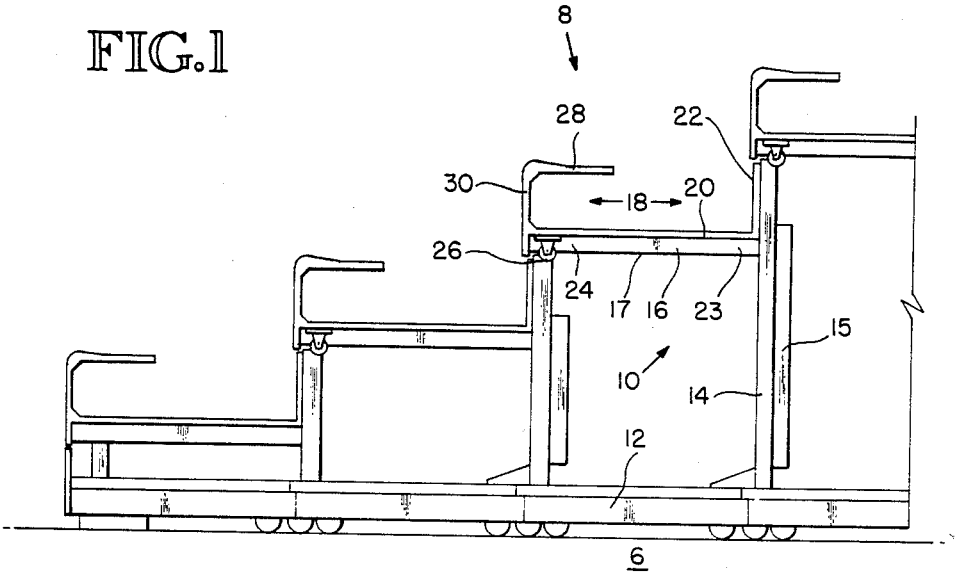
FIG. 1A
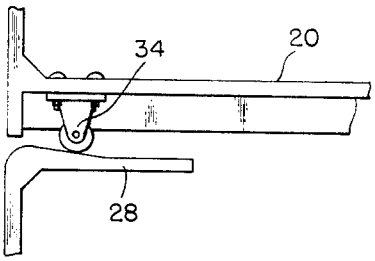
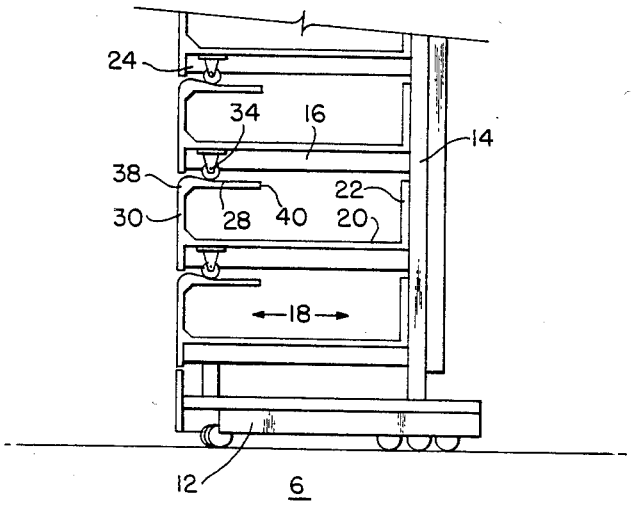
FIG. 2

FRONT-SUPPORTED TELESCOPING SEATING STRUCTURE

TECHNICAL FIELD

This invention relates to seating structures and, more particularly, to a telescoping seating structure which is stored in a rearward position with its rows superposed above each other.

BACKGROUND ART

Telescoping seating structures are most often used in school gymnasiums to provide temporary bleacher-type seating for sports events. In the extended position for seating use, the structure extends forwardly from a rear wall on the perimeter of a floor surface, with rows of seats arranged stepwise downward from the rear wall. When temporary seating is not required and the full floor surface is needed for athletic or other use, the structure is moved rearwardly to a retracted position for storage against the rear wall, with the rows superposed vertically above each other and the risers of the rows forming a vertical front plane.

In conventional telescoping seating structures each row is supported by a forwardly extending cantilevered arm fixed to a vertical post of predetermined height. When the seating structure is in the extended position, with the rows in stepped relation, the free end of each cantilevered arm is supported by the upper end of the vertical post of the next forward row, providing a sturdy support for each row. A problem is presented in supporting the seats when the structure is in the retracted position, with the rows supported only by the cantilevered arms.

Bystanders and other persons sometimes climb on the front risers in the front plane of the retracted structure, placing large loads on the forward free ends of the cantilevered arms. Under such loads, which can exceed 200 pounds, the free end of the cantilevered arm of each loaded row deflects downwards, engaging the seating surface of the next lower row, and that row with the next lower, and so on, until either a sufficient number of rows are engaged to carry the entire load, or until the seating surface of the bottommost row of seats is engaged.

The gap between the front riser of each row and the seating surface of the next lower row may be only a fraction of an inch. The bottommost row does not deflect at all, being fixedly supported by the wheels of the carriage assembly of that row. Under the load from a person climbing the front face of the retracted telescoping seating structure, the second row, immediately above the bottommost row, will deflect a distance no more than the width of the clearance gap between those rows. The third row, immediately above the second row, will deflect up to twice that distance; the fourth row will deflect up to three times that distance; and so on, up to the row supporting the climber. The cumulative deflection imposed on the upper loaded rows can be sufficient to cause permanent deformation of their cantilevered arms. The permanent deformation which occurs may prevent movement of the seating structure from its extended position to its retracted position.

A further problem is presented when the seating structure is used in a location with an uneven floor surface. The unevenness may produce a lack of vertical alignment of the rows as a result of the different heights of the rear supporting vertical posts, which are each carried by a wheeled carriage engaging the floor. If the floor surface is excessively uneven, the clearance gaps between the risers may close completely or overlap, preventing movement of the seating structure from its extended position to its retracted position and requiring time-consuming precision adjustment of the seating structure or expensive resurfacing of the floor surface.

DISCLOSURE OF INVENTION

The present invention resides in a telescoping seating structure comprised of a plurality of rows of seats which can be moved between a forward extended position for seating use and a rearward retracted position for storage against a rear wall. Each row includes two or more row assemblies, each having a carriage assembly capable of forward and rearward movement across a horizontal floor surface, a vertical post rigidly attached to and extending upwardly from the carriage assembly, with an upper end at a predetermined height above the floor surface, and a horizontal cantilevered arm rigidly attached to the vertical post at a preset distance below the upper end of the vertical post, and extending forwardly from the vertical post for a preset distance.

A seating assembly spans between the row assemblies of each row. Each seating assembly includes a vertical front riser positioned adjacent to a free end of the cantilevered arm and extending upwardly for a preset distance above an upper surface of the cantilevered arm, a bleacher-type seat rigidly attached to an upper end of the front riser and extending rearwardly from the front riser for a preset distance, a horizontal tread panel positioned upon an upper surface of the cantilevered arm and extending from the forward free end of the cantilevered arm to a rearward end of the cantilevered arm adjacent to the vertical post, and a vertical rear riser positioned adjacent to the front face of the vertical post and extending upwardly from the upper surface of the cantilevered arm to a point immediately below the upper end of the vertical post. A front support is rigidly attached to a lower surface of the cantilevered arm or a lower surface of the tread panel at a preset distance rearwardly from the front face of the front riser. The front support is capable of supporting the row upon an upper surface of the seat of an adjacent row below when the seating structure is in the retracted position for storage against the rear wall.

In the presently preferred embodiment of the invention, the front support is a wheel which engages a forward portion of the upper surface of the seat of the adjacent row below when the structure is in the retracted position, and the entire seating assembly, comprised of the seat, front riser, tread panel and rear riser, is constructed as an integral unit from molded fiberglass.

Other features and advantages of the present invention will become apparent from the following detailed description, taken in conjunction with the accompanying drawings.

BRIEF DESCRIPTION OF THE DRAWINGS

FIG. 1 is a side elevation of a preferred embodiment of the telescoping seating structure of this invention in the extended position, with the free end of the cantilevered arm of each row supported on the vertical post of the adjacent row below.

FIG. 1A is a detailed side elevation of the embodiment of FIG. 1 in the retracted position, showing the front support of each row engaging the upper surface of the seat of the adjacent row below.

FIG. 2 is a side elevation of the embodiment of FIG. 1 in the retracted position, with the free end of the cantilevered arm of each row supported by a front support wheel engaging the upper surface of the seat of the adjacent row below.

BEST MODE FOR CARRYING OUT THE INVENTION

As best seen in FIG. 1, a preferred embodiment of a front-supported telescoping seating structure of the present invention is composed of a plurality of rows 8, each row including two or more supporting row assemblies 10 and a seating assembly 18 spanning laterally between the row assemblies. Each row assembly 10 includes a carriage assembly 12, a vertical post 14, and a cantilevered arm 16. The seating assembly 18 includes a bleacher-type seat 28, a vertical front riser 30, a horizontal tread panel 20, and a vertical rear riser 22. The seating structure is capable of movement horizontally across a floor surface 6 between a forward extended position for seating use with the rows arranged stepwise, and a rearward retracted position for storage against a rear wall with the rows superposed vertically above each other.

The carriage assembly 12 rollably engages the floor surface 6 and is capable of horizontal translation in a direction of movement of the seating structure between the extended and retracted positions. The vertical post 14 is rigidly attached to a rearward portion of the carriage assembly 12, and extends vertically from the carriage assembly to a predetermined height above the floor surface 6. The cantilevered arm 16 is rigidly attached to the vertical post 14 and extends forwardly from a rearward fixed end 23 attached to the vertical post a preset distance from the vertical post to a forward free end 24.

The vertical front riser 30 of the seating assembly 18 is positioned adjacent to the forward free end 24 of the cantilevered arm 16, and extends upwardly to a preset height above an upper surface of the cantilevered arm. The bleacher-type seat 28 is rigidly attached to an uppermost portion of the front riser 30, and extends rearwardly from the front riser. The tread panel 20 is positioned upon an upper surface of the cantilevered arm 16, and extends rearwardly from the free end 24 of the cantilevered arm to the fixed end 23 adjacent to the vertical post 14. The tread panel 20 is rigidly attached to the front riser 30 and the rear riser 22. The rear riser 22 is positioned adjacent to a forward vertical surface of the vertical post 14, and extends upwardly from the upper surface of the cantilevered arm 16 to a point immediately below an upper end 26 of the vertical post. The entire seating assembly 18, comprising the seat 28, front riser 30, tread panel 20 and rear riser 22 is manufactured as an integral unit from molded fiberglass.

Each row assembly 10 is laterally supported against sway in a direction perpendicular to the direction of movement of the seating structure, by a pair of lateral braces 15. Each lateral brace 15 is rigidly attached to a lower portion of the vertical post 14 at a point above the carriage assembly 12, and extends upwardly and laterally therefrom to a rigid attachment of the seating assembly 18 carried by the carriage assembly at a point between the two row assemblies 10 for the row 8. The lateral brace 15 is well known in the prior art.

When the seating structure is in the forward extended position for seating use, as shown in FIG. 1, the rows are arranged stepwise, ascending from the forward lowest row to the rearward uppermost row, providing the spectators seated in each row with an unobstructed view over the spectators seated on the rows forward and below. In the extended position, the bleacher-type seat 28, positioned toward the free end 24 of the cantilevered arm 16, is vertically supported by the cantilevered arm, which is in turn vertically supported on an upper end 26 of the vertical post 14 of the adjacent row forward and below. This method of supporting the seat 28 and tread panel 20 upon the adjacent row below provides a sturdy support for spectators seated on the seat 28 and walking on the tread panel 20, and is well known in the art.

When the seating structure is in the rearward retracted position for storage against the rear wall, as shown in FIG. 2, the rows 8 are superposed vertically above each other. The free end 24 of the cantilevered arm 16 of each row assembly 10 is vertically supported on a front support wheel 34 engaging an upper surface of the seat 28 of the adjacent row below. The front support wheel 34 is rigidly attached to a bottom surface of the tread panel 20 or the bottom surface 17 of cantilevered arm 16. The front support wheels 34 for the rows 8 creates a continuous series of supports from the free end 24 of each cantilevered arm downward, through the seats 28 and front supports 34 of the rows below, to a bottommost row, which directly engages the floor surface 6. When a vertical load is imposed upon the front riser 30 of a row, that load is transmitted downward, through the intervening rows below to the floor surface 6, and a minimal vertical deflection is created in the uppermost loaded row, thus solving a major problem with the seating structures of the prior art.

As shown in FIG. 1A, the front support wheel 34 engages a forward portion of the upper surface of the bleacher-type seat 28, so as to create a minimal bending moment in the rigid connection between the seat 28 and front riser 30. Construction of the seating assembly 18, comprising the seat 28, front riser 30, tread panel 20 and rear riser 22, as an integral unit from molded fiberglass produces a strong, rigid connection between the front riser 30 and the seat 28. When the seating structure is moved from the retracted position forwardly toward the extended position, the front support wheel 34 of each row 8 remains relatively stationary, while the seat 28 of the adjacent row below moves forwardly beneath it. The upper surface of a forward portion 38 of the seat 28 is elevated above the upper surface of a rearward portion 40 of the seat, such that during movement of the seating structure out of the retracted position, the seat 28 of the adjacent row below gradually and rollably disengages from the front support wheel 34, until the front support wheel is completely disengaged and the seating assembly is entirely supported by the cantilevered arm 16 and the vertical post 14.

As the seat 18 and front support wheel 34 disengage, the free end 24 of the cantilevered arm 16 deflects downward by a small amount. The upper surface of the seat 28 is inclined downwardly and rearwardly so that the downward deflection upon disengagement of the rows does not cause a lower edge of the front riser 30 to contact the rearward portion 40 of the seat 28 of the adjacent row below. In the presently preferred embodiment, where the seating assembly 18 is manufactured from molded fiberglass, the seat 28 is contoured so as to provide this incline. Additionally, the lowest point of the front support wheel 34 must extend below the lower edge of the front riser 30 in order to prevent contact between the lower edge of the front riser and the upper surface of the seat 28 of the adjacent row below, when the structure is moved forwardly out of or rearwardly into the retracted position for storage.

It wll also be appreciated that, although a specific embodiment of the invention has been described herein for purposes of illustration, various modifications may be made without departing from the spirit and scope of the invention. Accordingly, the invention is not limited except as by the appended claims.

I claim:

1. A telescoping seating structure having a plurality of rows, capable of horizontal movement across a floor surface between a rearward retracted position for storage against a rear wall, with a plurality of rows superposed vertically above each other, and a forward extended position for seating use, with the rows arranged stepwise downward from the rear wall, wherein each row comprises:

two or more row assemblies, each having a carriage assembly supportable on a floor surface by a plurality of wheels and capable of horizontal movement across the floor surface, a substantially vertical post rigidly attached to the carriage assembly and extending upwardly to a predetermined height above the floor surface, and a cantilevered arm rigidly attached to the vertical post a preset distance below the top of the vertical post and extending forward a preset distance from the vertical post;

a seating assembly attached to the cantilevered arm and spanning laterally between the row assemblies having a substantially vertical rear riser positioned above a fixed end of the cantilevered arm and extending from an upper surface of the cantilevered arm to a point just below the upper end of the vertical post, a horizontal tread panel engaging the upper surface of the cantilevered arm and extending forwardly from the fixed end of the cantilevered arm to a free end of the cantilevered arm, a substantially vertical front riser adjacent to the free forward end of the cantilevered arm and extending vertically from a point below a lower surface of the cantilevered arm to a point at a preset distance above the upper surface of the cantilevered arm, and a substantially horizontal bleacher-type seat rigidly connected to the front riser and extending rearwardly from the front riser toward the rear riser; and a front support extending below both the lower surface of the cantilevered arm and a lower edge of the front riser, to a position to engage an upper surface of the seat of an adjacent row below for supporting the seat, front riser, tread panel and cantilevered arm when the structure is in the retracted position with the rows superposed vertically above each other.

2. The seating system of claim 1 wherein the front support is a wheel capable of rollably engaging the upper surface of the seat of the adjacent row below as the structure is moved into the retracted position.

3. The seating system of claim 2 wherein the front support wheel is mounted on the lower surface of the cantilevered arm with its rotational axis horizontal and perpendicular to the direction of operation of the seating structure.

4. The seating structure of claim 3 wherein the front support wheel extends to a position below the lower surface of the cantilevered arm sufficient for the front support wheel to rollably contact the upper surface of the seat of the adjacent row below without imposing any substantial load upon the adjacent row below.

5. The seating structure of claim 4 wherein the front support wheel is mounted rearwardly from the front face of the front riser by a preset distance, sufficient for the front wheel to engage a forward portion of the upper surface of the seat of the adjacent row below when the structure is in the retracted position.

6. The seating structure of claim 5 wherein the upper surface of the seat is inclined downwardly from the forward portion of the seat rearwardly toward a rearward portion of the seat nearer to the rear riser and the front support wheel of each row engages only the forward portion of the upper surface of the seat of the adjacent row below without contacting the rearward portion of the seat during movement of the structure between the extended and retracted positions.

7. The seating structure of claim 6 wherein a vertical dimension of the front riser is sized to avoid the lower edge of the front riser contacting the upper surface of the seat of the adjacent row below during operation of the structure between the extended and retracted positions.

8. The seating structure of claim 6 wherein the upper surface of the seat is contoured.

9. The seating structure of claim 8 wherein the seat is constructed of molded fiberglass.

10. The seating structure of claim 9 wherein the seating assembly, consisting of the seat, the front riser, the tread surface, and the rear riser are constructed from molded fiberglass as an integral unit.

11. A telescoping seating structure having a plurality of rows, each row comprising:

one or more row assemblies, each row assembly having a support assembly capable of movement across a horizontal surface, a substantially vertical post supported upon the support assembly and extending upwards to a predetermined distance above the horizontal surface, and a cantilevered arm rigidly attached to and extending forwardly from the vertical post;

a seat assembly supported by the row assemblies, each seat assembly having a seat supported by the cantilevered arm; and a front support for supporting an upper row upon the seat of an adjacent row below when the seating structure is in a retracted position for storage.

12. The seating structure of claim 11 wherein the front support is a wheel.

13. The seating structure of claim 11 wherein the front support is attached to and extends below a lower surface of the cantilevered arm.

14. The seating structure of claim 11 wherein the seat assembly further includes a tread panel positioned upon an upper surface of the cantilevered arm, and the front support is attached to a lower surface of the tread panel.

15. The seating structure of claim 11 wherein the seat assembly further includes a substantially vertical front riser positioned toward a forward free end of the cantilevered arm, and the front support is mounted rearwardly from the front face of the front riser a preset distance so as to engage a forward portion of the seat of the adjacent row below.

16. The seating structure of claim 11 wherein the seat assembly further includes a substantially vertical front riser positioned toward a forward free end of the cantilevered arm, and an upper surface of the seat is inclined downwardly from the front riser rearwardly.

17. The seating structure of claim 16 wherein the upper surface of the seat is contoured.

18. The seating structure of claim 17 wherein the seat is manufactured from molded fiberglass.

19. A telescoping seating structure with a plurality of rows, each row having a plurality of row assemblies, each row assembly having a carriage assembly, a vertical post, and a cantilevered arm, with a seating assembly having a seat, a front riser, a tread panel, and a rear riser, spanning between the row assemblies, the improvement comprising a front support wheel attached to a lower surface of the cantilevered arm or a lower surface of the tread panel and capable of supporting the row upon a forward portion of an upper surface of the seat of the adjacent row below when the structure is in a rearward retracted position for storage.

20. A telescoping seating structure, capable of movement between an extended position for seating use and a retracted position for storage against a rear wall, having a plurality of rows, each row having:

two or more row assemblies, each row assembly having a movable support assembly with wheels or other means for movement across a horizontal floor surface, a substantially vertical post rigidly attached to the movable support assembly, and extending upwards to a predetermined height above the floor surface, and a cantilevered arm rigidly attached to a forward surface of the vertical post at a preset distance below an upper end of the vertical post, and extending forwardly from the forward surface of the vertical post for a preset distance;

a seating assembly spanning horizontally and laterally between the row assemblies, each seating assembly having a vertical front riser positioned adjacent to a forward free end of the cantilevered arm, extending upwardly to a preset distance above an upper surface of the cantilevered arm, and further extending downwardly for a preset distance below a lower surface of the cantilevered arm, a substantially horizontal seat rigidly attached to an upper end of the front riser, and extending rearwardly for a preset distance from the front riser, a horizontal tread panel positioned upon the upper surface of the cantilevered arm, rigidly attached to the front riser, and extending rearwardly from the front riser to the front surface of the vertical post; and a vertical rear riser, rigidly attached to a rearward portion of the tread panel, and extending upwardly from the tread panel to a point at a preset distance below an upper end of the vertical post; and a front support wheel attached to a lower surface of the tread panel a preset distance rearwardly from the front face of the front riser, engaging a forward portion of an upper surface of the seat of the adjacent row below when the structure is moved into a retracted position.

* * * * *